United States Patent [19]

Asano

[11] 4,170,969

[45] Oct. 16, 1979

[54] AIR FUEL MIXTURE CONTROL APPARATUS FOR INTERNAL COMBUSTION ENGINES

[75] Inventor: Masaharu Asano, Yokohama, Japan

[73] Assignee: Nissan Motor Company, Limited, Japan

[21] Appl. No.: 818,955

[22] Filed: Jul. 25, 1977

Related U.S. Application Data

[63] Continuation of Ser. No. 628,903, Nov. 5, 1975, abandoned.

[30] Foreign Application Priority Data

Jun. 11, 1974 [JP] Japan ..... 49-127655
Jun. 18, 1975 [JP] Japan ..... 50-73054

[51] Int. Cl.[2] ..... F02B 3/00
[52] U.S. Cl. ..... 123/32 EE
[58] Field of Search ..... 123/32 EE, 32 E, 32 EA, 123/119 EC; 60/276, 271, 285

[56] References Cited

U.S. PATENT DOCUMENTS

| | | | |
|---|---|---|---|
| 3,916,170 | 10/1975 | Norimatsu et al. | 123/32 EA |
| 3,919,983 | 11/1975 | Wahl et al. | 123/32 EE |
| 3,938,075 | 2/1976 | Reddy | 60/285 |
| 3,938,479 | 2/1976 | Oberstadt | 123/32 EA |
| 3,949,551 | 4/1976 | Eichler et al. | 60/276 |

*Primary Examiner*—Charles T. Jordan
*Attorney, Agent, or Firm*—Lowe, King, Price & Becker

[57] ABSTRACT

In a closed loop air fuel mixture control system in which an exhaust gas sensor is provided to control the mixture ratio, a detector is provided to detect an operating condition of the engine to change the control from the closed mode to an open control mode when the exhaust gas sensor begins to fail under the sensed operating condition.

12 Claims, 13 Drawing Figures

16
10
O2 SENSOR
14
COMP.
CLOCK
301
AND
302
COUNTER
303
CLOCK
304
AND
305
COUNTER
306
OR
307
S Q
R Q̄
308
ALARMING DEVICE
22
OR
TO PI CONTROLLER 18
MANUAL
316
AUTO
317
MANUAL RESET
OR
311
S Q
R Q̄
MN MVTR
313
S Q
R Q̄
MN MVTR
314
312
315
CHANGE OF STATE DETECTOR 310

AIR FUEL MIXTURE CONTROL APPARATUS FOR INTERNAL COMBUSTION ENGINES

This is a continuation of application Ser. No. 628,903, filed Nov. 5, 1975, now abandoned.

The present invention relates to air fuel mixture control apparatus for an internal combustion engine.

Various methods have been proposed to control the air fuel mixture ratio at the stoichiometric value utilizing after-combustion data as obtained from an exhaust gas sensor, for example, an oxygen sensor. Such an oxygen sensor is constructed of a hollow tube of zirconium dioxide disposed in the exhaust passage of the engine and provides an output voltage with a very sharp characteristic change in amplitude at the stoichiometric air fuel ratio. The output voltage represents the amount of oxygen contained in the exhaust gas when the oxygen sensor is operating in the prescribed temperature range. However, under low temperature environment which might occur as a result of idling condition of the engine or for any reason, the oxygen sensor becomes incapable of delivering a correct composition representative signal. Moreover, a greater concentration of unburned gases is another factor that can degrade the performance of the oxygen sensor.

Therefore, the primary object of the present invention is to provide an air fuel mixture control apparatus in which the data obtained from the exhaust gas sensor is disabled during the time the engine is operating under conditions which adversely affect the performance of the exhaust gas sensor.

Another object of the invention is to change the closed loop mode of air fuel mixture control system to the open control mode whenever undesirable conditions have occurred to the exhaust gas sensor.

A further object of the invention is to provide air fuel mixture control apparatus which assures high stability in response to disturbances to the engine.

A further object of the invention is to prevent a catalytic convertor from being heated to an elevated temperature as it reacts with a greater concentration of unburned fuel components.

Briefly described, the output voltage from the oxygen sensor is compared with a desired voltage to provide an error signal which is fed into a proportional-integral (PI) controller for modulating the width of control pulses which determine the opening time of the fuel control valve. The error signal takes a value which varies in amplitude representing the difference in amount between the sensed composition and the desired value. In one aspect of the present invention, an abnormal condition detector is provided to detect the length of interval between transitions of the error signal levels above or below a predetermined level and provides an output when a predetermined period is reached. The output from the abnormal condition detector thus indicates that the oxygen sensor is not properly functioning and disables the PI controller as long as the malfunctioning continues. In another aspect of the invention, there is provided a detector to detect idling condition of the engine and a timing circuit coupled to the detector in order to disable the PI controller at a delayed timing from the instant the idling condition is detected. The timing circuit preferably provides another delayed timing operation from the instant the engine is started for cruising speed operation. The PI controller is thus held disabled during the time from the instant the first delayed interval has elapsed to the instant the vehicle has moved some distance. Such timing intervals after the idling and the cruising operations are effective for reducing noxious exhaust emissions at the time of transitions from closed loop control to open loop control and vice versa. Other engine operating condition detectors are provided which include a deceleration condition detector and a low engine temperature detector to disable the controller. Such detectors provide information well in advance that the performance of the oxygen sensor begins to fail and serve to protect a catalytic convertor from an excessive heat which might occur as a result of a reaction with unburned fuel components.

These and other objects and advantages will be understood from the following description when taken in conjunction with the accompanying drawings, in which.

Figure 1:
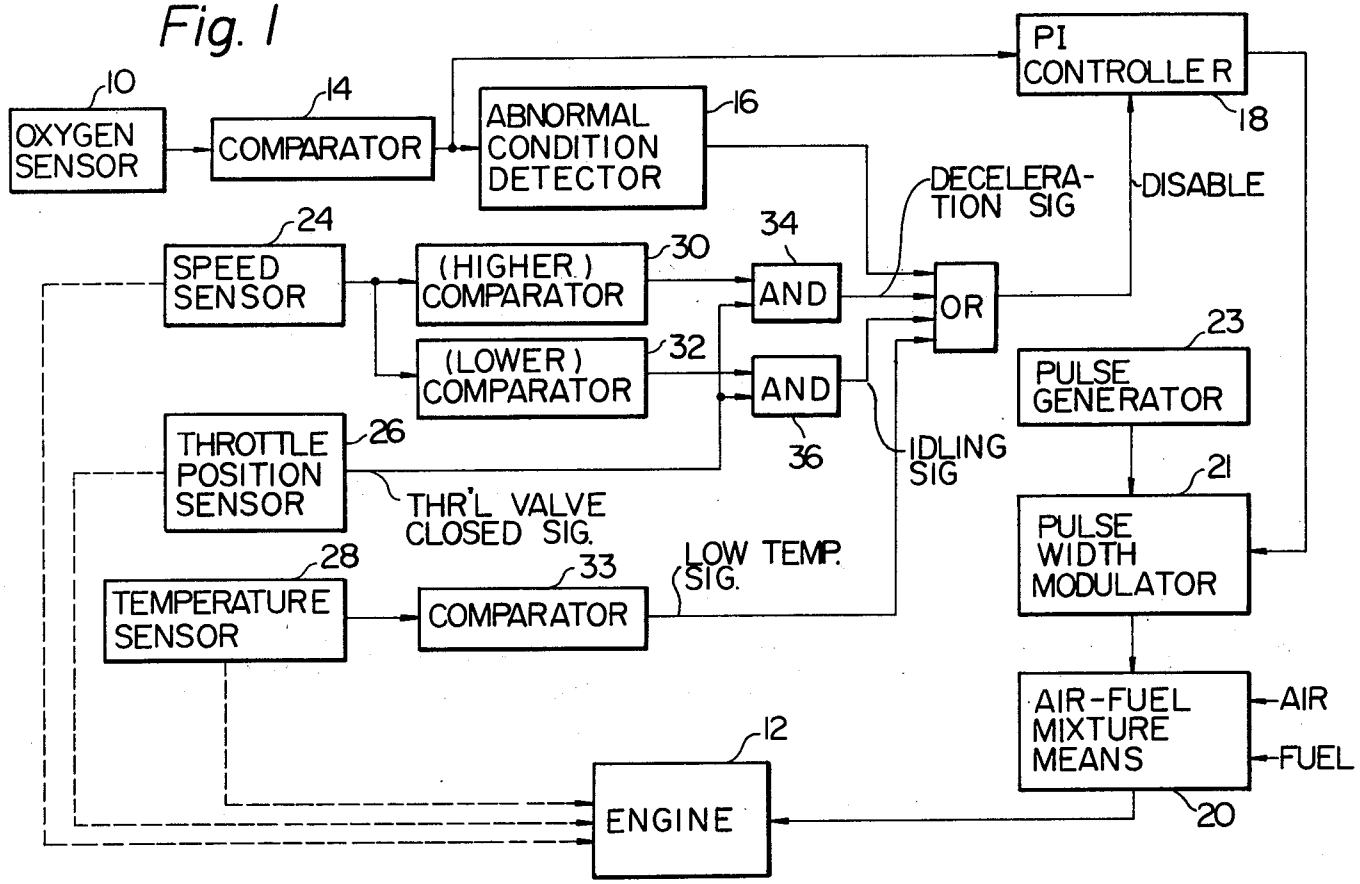
FIG. 1 is a schematic circuit diagram of air fuel mixture control apparatus of the present invention.
Figure 5A:
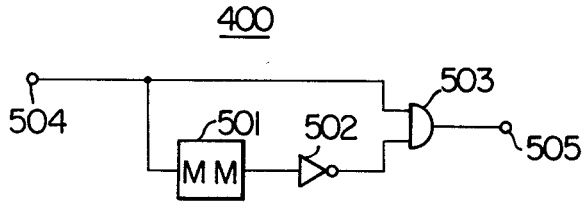
Figure 5B:
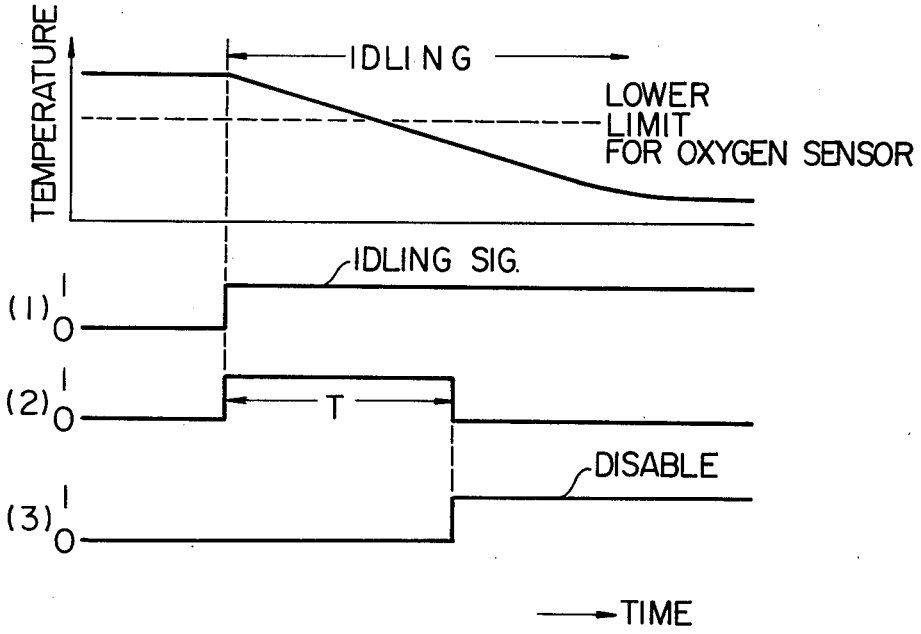
Figure 6A:
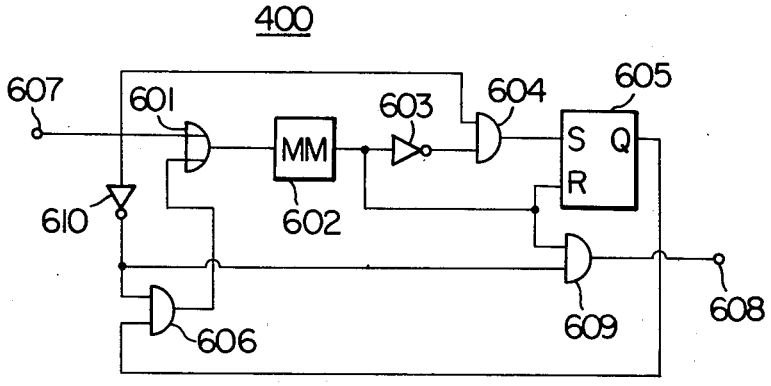
Figure 6B:
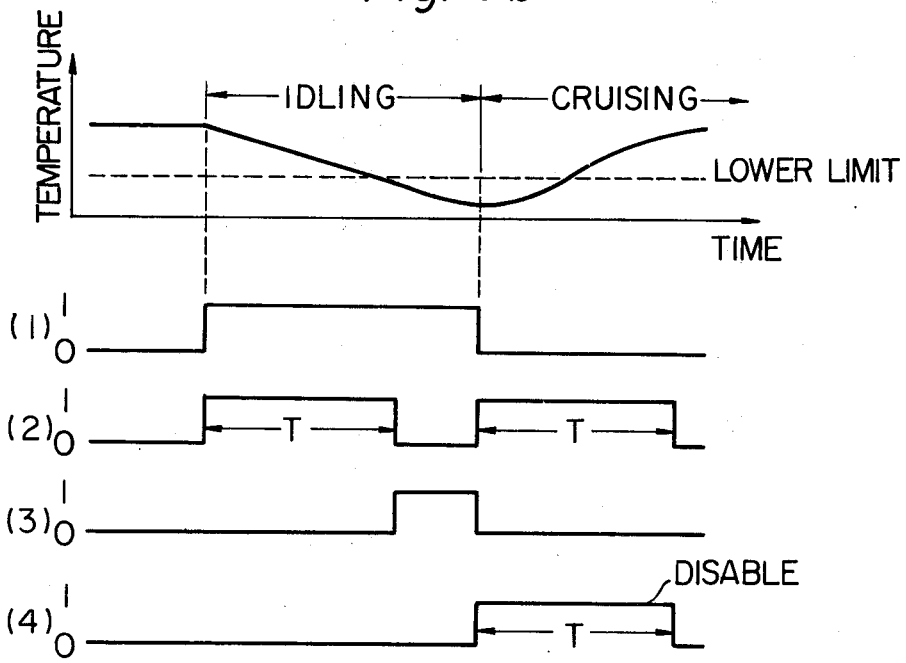
Figure 7A:
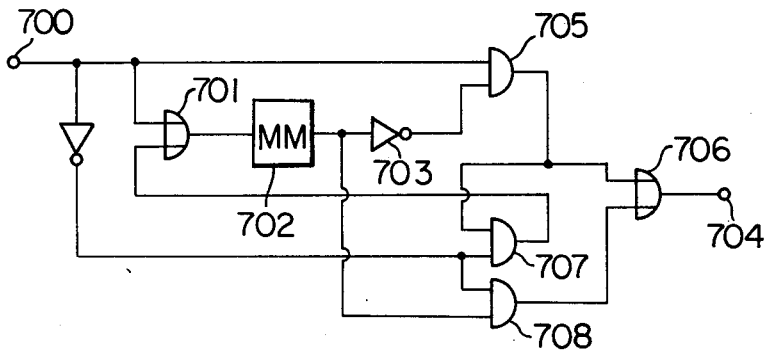
Figure 7B:
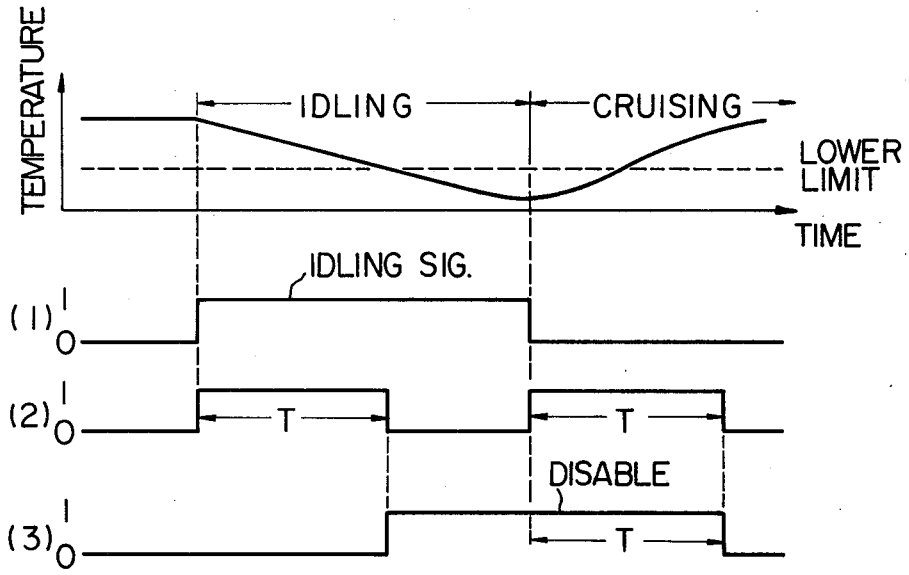
Figure 8A:
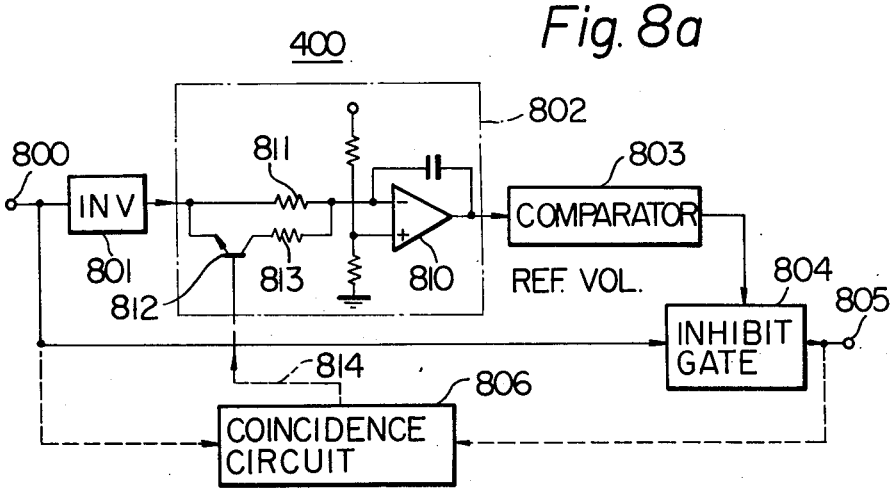
Figure 8B:
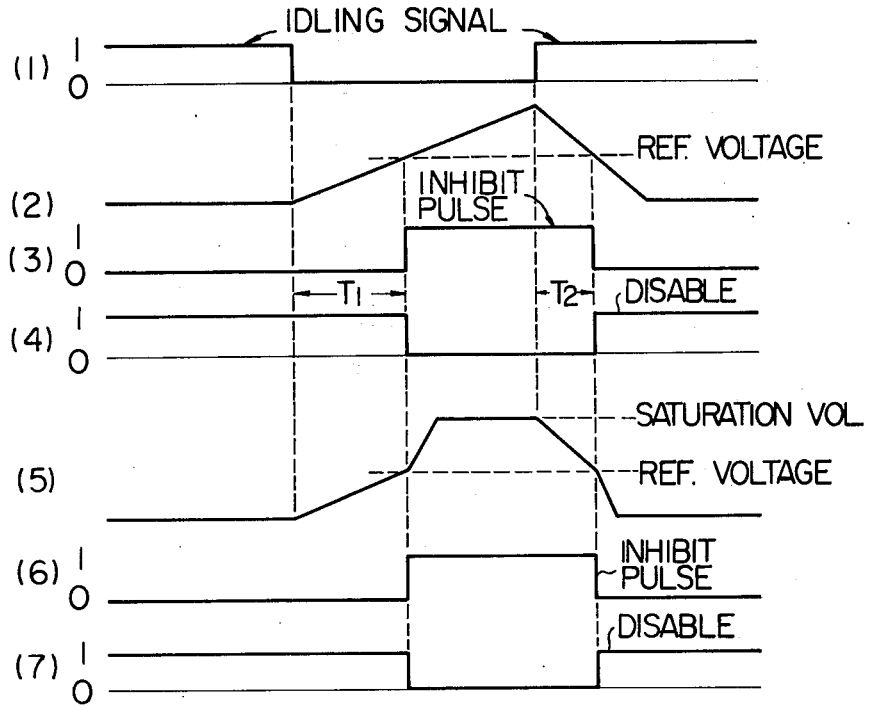
Figure 9:
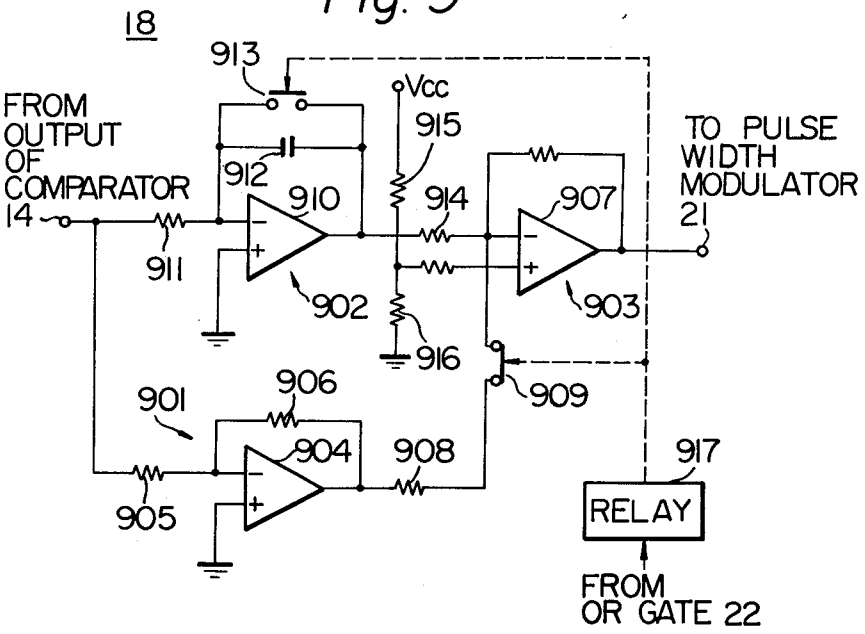

FIGS. 5*a* and 5*b* are a circuit diagram of an idling condition detector of the FIG. 1 circuit and a waveform diagram in connection with the circuit of FIG. 5*a*, respectively;

FIGS. 6*a* and 6*b* are a circuit diagram of a second form of the idling condition detector and a waveform diagram in connection with the circuit of FIG. 6*a*, respectively;

FIGS. 7*a* and 7*b* are a circuit diagram of a third form of the idling condition detector and a waveform diagram in connection with the circuit of FIG. 7*a*, respectively;

FIGS. 8*a* and 8*b* are a circuit diagram of a fourth form of the idling condition detector and a waveform diagram in connection with the circuit of FIG. 8*a*, respectively; and FIG. 9 is a circuit diagram of a proportional-integral controller of the circuit of FIG. 1.

Referring now to FIG. 1, an air-fuel mixture control system of the present invention for an internal combustion engine is shown and comprises an oxygen sensor 10 constructed of a hollow tube of zirconium dioxide which reacts with the amount of oxygen in the exhaust gases and provides an output voltage with a very sharp characteristic change in amplitude at the stoichiometric air fuel ratio. The output from the oxygen sensor 10 is coupled to a comparator 14 which may be a differential amplifier and compares it with the desired value. The difference between the values represents an error signal which is modified by a proportional-integral controller 18. The modified signal is used to determine the width of pulses to control the opening time of electromechanical valves as represented by an air-fuel mixture means 20. The control pulse may be obtained by a pulse width modulator 21 which modulates the width of pulses supplied from a pulse generator 23 in accordance with the signal from the PI controller 18. Therefore, the air-fuel mixture ratio is controlled by the output from the oxygen sensor.

Connected to the output of the comparator 14 is an abnormal condition detector 16 which measures the length of interval between transitions of signal level of the output and provides an output when that interval exceeds a predetermined period. The occurrence of signal at the output of the detector 16 indicates that an abnormal condition exists in the control loop and is used to disable the PI controller 18. Such abnormal condition may be triggered by a malfunctioning of the oxygen sensor 10 because of its inability to operate at temperatures below the prescribed value during the time of idling. In addition, the oxygen sensor 10 is not able to operate satisfactorily when the exhaust emissions contain much unburned gases. Such high concentration of unburned gases occurs during the time of deceleration.

In order to detect undesirable conditions, engine parameter sensors are provided which include an engine speed sensor 24, a throttle position sensor 26 and an engine temperature sensor 28. The output from the speed sensor 24 is coupled to comparators 30 and 32. The comparator 30 compares the output voltage from sensor 24 with a desired value and provides an output when the engine speed is higher than the predetermined speed. Throttle position sensor 26 provides an output when the throttle valve is fully closed. The output from the comparator 30 and throttle position sensor 26 are applied to an AND gate 34. A high level at the output of AND gate 34 indicates that the vehicle is under decelerating condition. The comparator 32 on the other hand compares the speed sensor output with a desired value and provides an output when the engine speed is below the predetermined speed. The outputs from the throttle position sensor 26 and the comparator 32 are connected to an AND gate 36 to deliver a high level output which indicates that the vehicle is under the idling condition. The decelerating and idling condition signals are applied to the PI controller 18 via the OR gate 22 to disable the same.

In order to disable the PI controller 18 when the engine temperature is low to thereby save the system from the malfunctioning oxygen sensor 10, an engine temperature sensor 28 is provided. The temperature-related signal from the temperature sensor 28 is compared with a desired value by a comparator 33 which provides an output when the engine temperature is below the predetermined temperature. The output from the comparator 33 is connected to the PI controller 18 via the OR gate 22 to disable the same.

Figure 2:
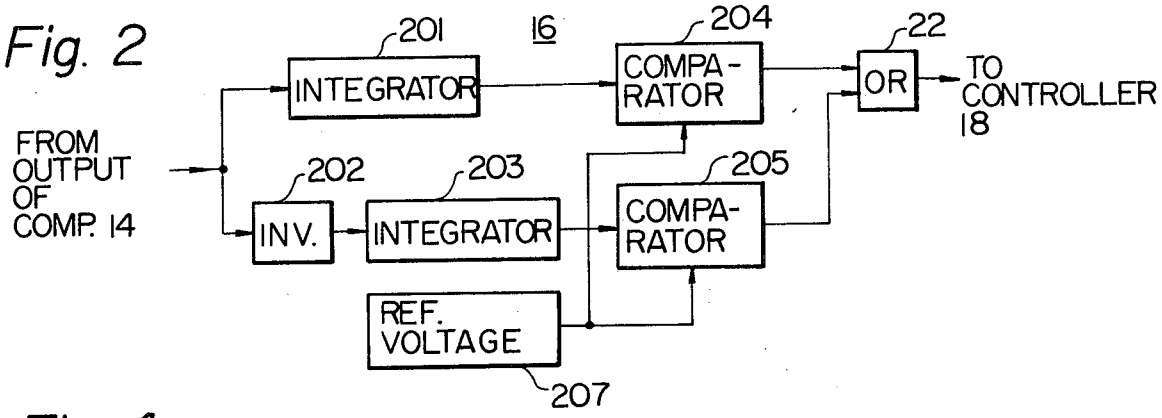
FIG. 2 is a schematic diagram of an abnormal condition detector employed in the circuit of FIG. 1.

FIG. 2 illustrates a circuit required to perform the function of the abnormal condition detector 16. The signal from the comparator 14 is coupled to an integrating circuit 201 on one hand and to an integrator 203 via an invertor 202 on the other. Comparators 204 and 205 are connected to the output circuits of integrators 201 and 203, respectively. The integrator 201 integrates the comparator output while it remains high, while the integrator 203 integrates the comparator output while it remains low. Each of the comparators 204 and 205 compares the input voltage with a predetermined voltage delivered from a reference voltage source 207 and provides an output to the PI controller 18 via the OR gate 22.

Figure 3:
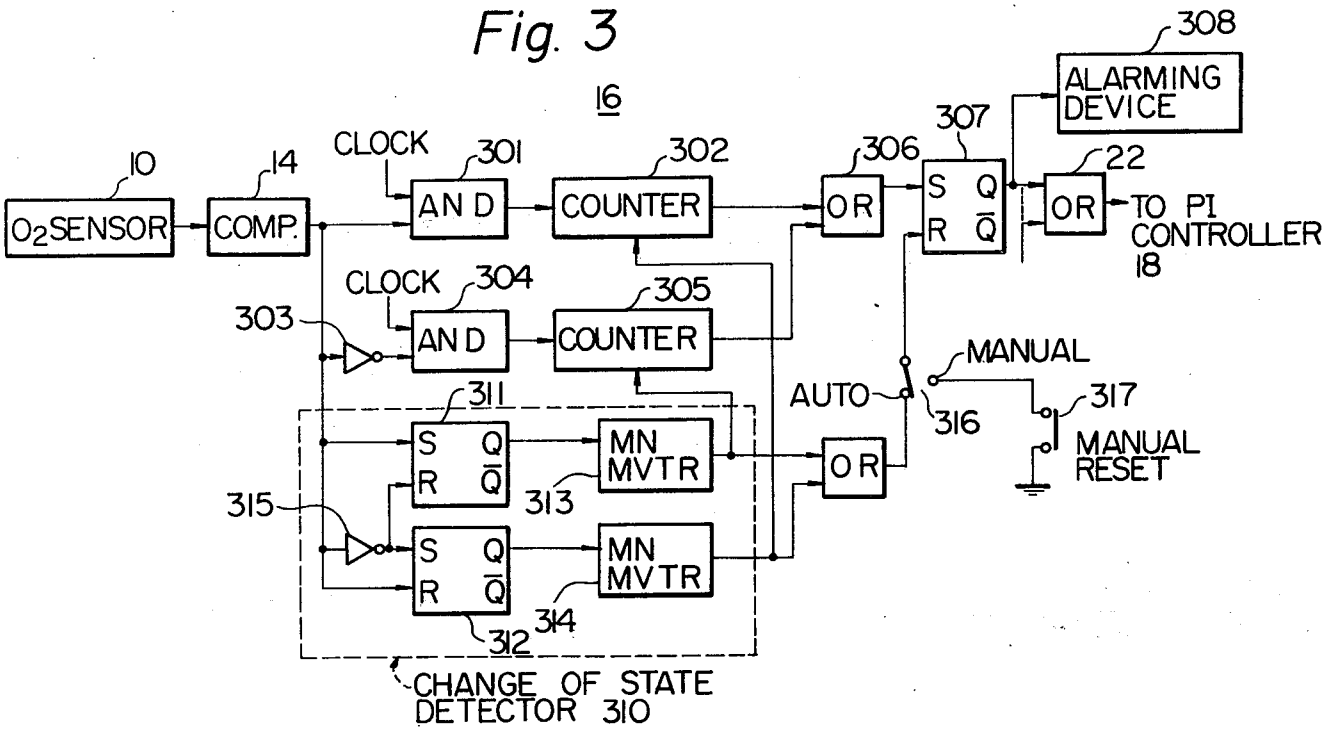
FIG. 3 is a schematic diagram of another embodiment of the abnormal condition detector.

An alternative circuit of the abnormal condition detector 16 is shown in FIG. 3. The high level output from the comparator 14 enables an AND gate 301 to pass clock pulses to a counter 302 which provides an output when the count reaches a predetermined number, while the low level signal is polality inverted by an invertor 303 to enable an AND gate 304 which passes the clock pulses to a counter 305 which in like manner counts the clock to provide an output when the same count is reached as in counter 302. The outputs from the counters 302 and 305 are applied to the set terminal of a flip-flop 307 via an OR gate 306, the Q output of flip-flop 307 going high to disable the PI controller 18 via OR gate 22 and to operate an alarming device 308. In order to bring the PI controller 18 into closed circuit again when the abnormal condition dissapears, a change-of-state detector 310 is connected to the output of comparator 14. The detector 310 includes two flip-flops 311 and 312 and two monostable multivibrators 313 and 314 connected to the Q output terminals of flip-flops 311 and 312, respectively. The flip-flop 311 has its set terminal connected to the output of comparator 14 and its reset terminal connected thereto via an invertor 315, while the flip-flop 312 has its set terminal connected to the comparator output via the invertor 315 and its reset terminal connected directly thereto. When the low level signal at the input to flip-flop 311 changes to high, monostable multivibrator 313 is caused to produce a pulse which is coupled to the counter 305 in which a count may have been reached during the interval the low level signal continued. Thus, a change of state from low to high level signals is detected and the counter 305 is cleared. In like manner, when a high level signal changes to low, flip-flop 312 is set by the inverted signal and causes monostable multivibrator 314 to produce an output which is applied to the counter 302, and thus a change of state from high to low is detected and the counter 302 is cleared. When the detector 16 is in the automatic mode, the outputs from the change-of-state detector 310 are connected to the reset terminal of flip-flop 307 via the "AUTO" position of an "AUTO-MANUAL" transfer switch 316 to remove the high level signal from the Q output terminal of flip-flop 307. In the manual mode, the switch 316 is transferred to the manual position, and the flip-flop 307 is reset by a manual reset switch 317.

Figure 4:
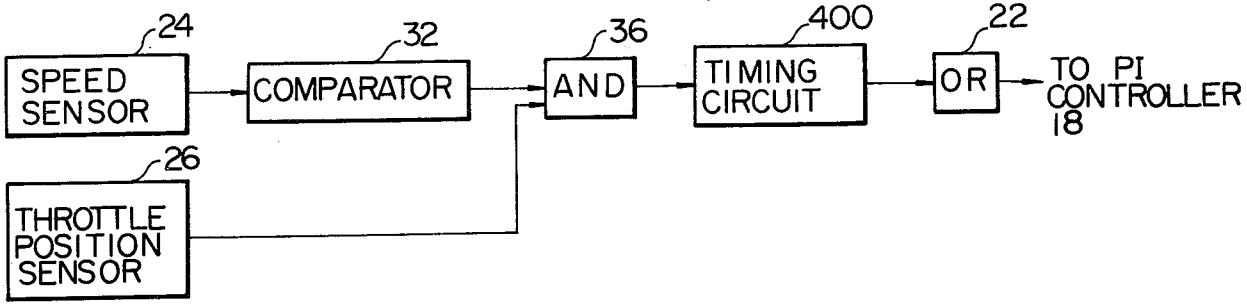
FIG. 4 is a schematic diagram of a preferred form of the FIG. 1 circuit.

The circuit of FIG. 1 is modified by the provision of a timing circuit 400 connected between the output of AND gate 36 and the input of OR gate 22, as shown in FIG. 4. A first form of the timing circuit 400 comprises, as shown in FIG. 5*a*, a monostable multivibrator 501 and an invertor 502 are connected in series between one input of an AND gate 503 and the input terminal 504 to which the output from the AND gate 36 is applied. The AND gate 503 has its other input terminal connected directly to the input terminal 504. The operation of the circuit of FIG. 5*a* will be explained in connection with FIG. 5*b*. Upon occurrence of a signal (FIG. 5*b*-1) from the idling condition detector which comprises the speed sensor 24, throttle position sensor 26, comparator 32 and AND gate 36, the monostable multivibrator 501 produces a pulse having a duration of T (FIG. 5*b*-2). This pulse is inverted in polarity by the invertor 502 and coupled to and inhibit the AND gate 503. Therefore, the output of AND gate 503 goes high at the trailing edge of the pulse produced by the multivibrator 501 (FIG. 5*b*-3) and applied to the controller 18 via the output terminal 505 and OR gate 22. As shown in FIG. 5*b*, when the temperature within the exhaust passage begins to fall at the instant idling condition begins, the multivibrator 501 is triggered to produce the pulse T. As the idling condition continues the temperature in the exhaust passage falls below the temperature at which the oxygen sensor 10 is not capable of operating satisfactorily, as indicated by dashed lines. The output from the timing circuit 400 occurs after the temperature in the exhaust passage falls below the lower limit temperature for the oxygen sensor 10.

A second form of the timing circuit 400 is shown in FIG. 6*a*. The sensed idling signal (FIG. 6*b*-l) from the AND gate 36 of the idling detector is applied to a monostable multivibrator 602 via an OR gate 601. A first pulse having a duration of "T" (FIG. 6*b*-2) is produced and inverted by an invertor 603 to disable an AND gate 604 while the multivibrator output remains high. The AND gate 604 places a high level input (FIG. 6*b*-3) to the set terminal of flip-flop 605 at the trailing edge of the pulse. The high level Q output is connected to an AND gate 606. The idling signal at the input terminal 607 is also coupled to an invertor 610 and inverted thereby. The inverted signal is passed through AND gate 606 and OR gate 601 to the monostable multivibrator 602 to produce a second pulse (FIG. 6*b*-2). This second pulse appears at the output terminal 608 via an AND gate 609 since it is enabled by the high level signal at the output of invertor 610 while resetting the flip-flop 605 (FIG. 6*b*-4).

In this embodiment, the PI controller 18 is inhibited during time "T" from the instant the vehicle begins to cruise. The temperature in the exhaust passage falls to a temperature below the lower limit for the oxygen sensor 10 until it rises again as the vehicle gathers speed.

A third form of the timing circuit 400 is shown in FIG. 7*a*. The sensed idling signal (FIG. 7*b*-1) applied to the input terminal 700 triggers an monostable multivibrator 702 via an OR gate 701 to produce a pulse having a duration "T" (FIG. 7*b*-2) which is inverted by an invertor 703 and applied to an AND gate 705 to which is also coupled the signal on input terminal 700. The AND gate 705 produces a high level signal when the time "T" has elapsed (FIG. 7*b*-3). The high level output from the AND gate 705 is connected to the output terminal 704 via an OR gate 706 and at the same time applied to one input of an AND gate 707 to which is also applied the inverted of signal on input terminal 700. The AND gate 707 produces a high level signal when the idling signal goes low as the vehicle begins to move at cruising speeds, this high output from AND gate 707 being coupled to the monostable multivibrator 702 via OR gate 701 to trigger a second pulse. The second pulse is applied to an AND gate 708 and passed therethrough to the output terminal 704. Therefore, it will be noted that the PI controller 18 is inhibited from the trailing edge of the first timing pulse "T" to the trailing edge of the second timing pulse.

A forth form of the timing circuit 400 is shown in FIG. 8*a*. The idling signal (FIG. 8*a*-1) at the input terminal 800 is inverted by an invertor 801 and applied to an operational integrating circuit 802. The integrated signal (FIG. 8*b*-2) is compared with a desired value by a comparator 803 which provides an output which lasts from the instant the integrated signal is above the desired voltage level (FIG. 8*b*-3). The idling signal is also applied to the output terminal 805 via an inhibit gate 804. The output from the comparator 803 is used to inhibit the gate 804 so that the output terminal 805 goes low at the instant which is delayed by time $T_1$ from the end of idling condition and goes high again at the instant delayed by time $T_2$ from the instant an idling condition occurs again (FIG. 8*b*-4).

The integrating circuit 802 may preferably be of a variable rate integration type and constructed an operational amplifier 810 having its inverting input coupled to the output of invertor 801 via the input resistor 811. This input resistor has a parallel, shunt connection formed of the emitter-collector path of a transistor 812 and a resistor 813. The base electrode of the transistor 812, which is an npn switching transistor, is connected over lead 814 to the output of a coincidence circuit 806. The coincidence circuit 806 has two input terminals, one being connected to the input terminal 800 and the other connected to the output terminal 805. When the two input signals coincide with each other, the coincidence circuit 806 produces an output which is applied to the base of transistor 812. Transistor 812 conducts and places resistor 813 in parallel to resistor 811 and thus changing the integration rate of operational amplifier 810, as shown in FIG. 8*a*-5. The change in the rate of integration occurs both at the leading and trailing edges of the inhibit pulse. This arrangement is particularly advantageous when the vehicle experiences a rapid succession of idling and cruising conditions which is likely to take place during a congested traffic, since under such conditions the integrator 802 would begin integration in opposite direction before the integrated voltage reaches its saturation voltage.

The timing circuit 400 as described above provides various timing operations which allow delayed switching to change from closed to open control and vice versa. The delayed switching permits transition to occur more smoothly than otherwise because there exists a delayed time from the instant a disturbance to the system occurs to the instant a response is observed.

Another important factor that influences the smooth transition of operation from open to closed loop control is the amplitude of error signal provided at the output of PI controller 18 when switching is to be made; if the signal amplitude is high when the closed loop control is resumed, oscillation would occur in the closed loop, thus adversely affecting the system performance.

In order to avoid such undesirable consequences, the integrating gain of the integral control amplifier of the PI controller 18 is held to a minimum in response to the occurrence of the disabling signal applied to the controller 18.

FIG. 9 shows a circuit which is required to perform the aforesaid purpose. The PI controller 18 comprises a proportional control amplifier 901, an integrating control amplifier 902 and an adder circuit 903. The proportional and integrating control amplifier 901 and 902 have their inputs connected in common to the output of comparator 14 and their outputs connected in common to one input of the adder 903. The proportional control amplifier 901 comprises an operational amplifier 904 and has its inverting input terminal connected to the output of comparator 14 via a resistor 905 and further connected to its output via a resistor 906 and its noninverting input connected to ground reference. The output of the proportional amplifier 901 is coupled to the inverting terminal of an operational amplifier of adder 903 via an input resistor 908 and a normally closed relay contact 909. The integrating amplifier 902 comprises an operational amplifier 910 having its inverting terminal connected to the output of comparator 14 via a resistor 911 and further connected to its output terminal via an integrating capacitor 912 which is shunted by a normally open relay contact 913, and its noninverting terminal connected to ground. The output of the integrating amplifier 910 is coupled to the inverting terminal of amplifier 907 via an input resistor 914. The amplifier 907 of adder 903 has its noninverting terminal connected to a reference voltage provided at the junction between resistors 915 and 916 connected together in series across a voltage source Vcc and ground. The two signals from the proportional and integrating control amplifiers 901 and 902 are added up and connected to the input of the pulse width modulator 21. The relay contacts 909 and 913 are simultaneously operated when relay 917 is energized by the disabling signal from OR gate 22. The operation of relay 917 disconnects the output circuit of proportional controller 901, while short-circuiting the integral capacitor 912 of controller 902 thus bringing the output potential to zero. It will be noted therefore that when the closed loop control is resumed, i.e. when the disabling signal is removed, the voltage at the input to the adder 903 is at a minimum and thus no output will be delivered to the pulse width modulator 21.

What is claimed is:

1. Air fuel mixture apparatus for an internal combustion engine of an automotive vehicle, comprising:

means for detecting a composition of exhaust gases from said engine and providing a composition representative signal;

a control amplifier coupled to the exhaust composition detecting means to provide an error correction signal;

means for detecting when the amplitude of the exhaust composition detecting means is at a high level and when said amplitude is at a lower level;

means connected to said amplitude detecting means for measuring (1) a first period of time elapsed between transitions from the high level to the lower level and from the lower level to the high level and (2) a second period of time elapsed between transitions from the lower level to the high level and from the high level to the lower level;

means for comparing said first and second measured elapsed time periods with a predetermined time duration;

means responsive to said comparing means for disabling the control amplifier when either of said measured elapsed time periods is greater than said predetermined duration; and means responsive to the error correction signal for adjusting the mixture ratio of air to fuel to be supplied to said engine.

2. Air-fuel mixture control apparatus as claimed in claim 1, wherein said amplitude detecting means comprises a bistable device operable to assume a first stable state in response to said amplitude being at a high level and a second stable state in response to said amplitude being at the lower level, and wherein said time measuring and detecting means comprises first means for counting clock pulses during the time when said bistable device is in the first stable state to provide an output when the counted clock pulses reach a first predetermined number and second means for counting clock pulses during the time when said bistable device is in the second stable state to provide an output when the counted clock pulses reach a second predetermined number.

3. Air fuel mixture control apparatus as claimed in claim 1, further comprising means for detecting the deceleration condition of the vehicle.

4. Air fuel mixture control apparatus as claimed in claim 1, further comprising means for detecting the temperature of said engine and providing an output when the temperature is below a predetermined value.

5. Air fuel mixture control apparatus as claimed in claim 1, wherein said interval detecting means comprises means for integrating the composition representative signal and a comparator coupled to the integrating means to compare the integrated signal with a predetermined value.

6. Air fuel mixture control apparatus as claimed in claim 1, further comprising means for detecting the idling condition of the vehicle, and wherein said disabling means is responsive to said idling condition detecting means to disable the control amplifier.

7. Air fuel mixture control apparatus as claimed in claim 6, further comprising timing circuit means coupled to the idling condition detecting means to disable the control amplifier at a delayed timing from the instant said idling condition is detected.

8. Air fuel mixture control apparatus as claimed in claim 7, further comprising means for maintaining the control amplifier under the disabling condition for a predetermined interval from the instant said idling condition terminates.

9. Air fuel mixture control apparatus as claimed in claim 6, further comprising timing circuit means coupled to the idling condition detecting means for disabling the control amplifier at a point in time delayed from the instant said idling condition is detected and for maintaining the control amplifier under the disabling condition for a predetermined interval from the instant said idling condition terminates.

10. Air fuel mixture control apparatus as claimed in claim 9, wherein said timing circuit means comprises means for integrating a voltage in response to the termination of the idling condition, means for comparing the integrated voltage with a predetermined value, and gating means for permitting the idling condition detecting means to disable the control amplifier when the integrated voltage is below the predetermined value and preventing same from disabling the control amplifier when the integrated voltage is above the predetermined value.

11. Air fuel mixture control apparatus as claimed in claim 10, wherein said integrating means is of an operational integrating circuit of a variable rate integration type, and wherein a coincidence circuit is connected between the output of the idling condition detecting means and the output of the gating means to provide a coincidence output, said coincidence output being connected to the integrating circuit to change its rate of integration.

12. Air fuel mixture control apparatus as claimed in claim 1, further comprising means responsive to the interval detecting means to maintain the gain of said control amplifier to a minimum level while said control amplifier is disabled.

* * * * *